US008074589B2

(12) United States Patent
Fukao

(10) Patent No.: US 8,074,589 B2
(45) Date of Patent: Dec. 13, 2011

(54) THREAD WINDER AND SEWING MACHINE PROVIDED THEREWITH

(75) Inventor: Hiroaki Fukao, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 267 days.

(21) Appl. No.: 12/588,842

(22) Filed: Oct. 29, 2009

(65) Prior Publication Data

US 2010/0147989 A1 Jun. 17, 2010

(30) Foreign Application Priority Data

Dec. 15, 2008 (JP) ..... 2008-318223

(51) Int. Cl.
*D05B 59/00* (2006.01)
*D05B 43/00* (2006.01)

(52) U.S. Cl. ..... 112/279

(58) Field of Classification Search ..... 112/279, 112/254; 223/106; 242/364.4, 615, 125, 242/140
See application file for complete search history.

(56) References Cited

U.S. PATENT DOCUMENTS

| | | | | | |
|---|---|---|---|---|---|
| 2,858,089 | A | * | 10/1958 | Masayoshi | 242/134 |
| 3,426,713 | A | * | 2/1969 | Moro | 112/279 |
| 3,670,974 | A | * | 6/1972 | Ueltschi | 242/484.8 |
| 4,646,982 | A | * | 3/1987 | Spring | 242/484.8 |
| 4,771,714 | A | * | 9/1988 | Jimenez et al. | 112/279 |
| 4,936,234 | A | * | 6/1990 | Jimenez et al. | 112/259 |

FOREIGN PATENT DOCUMENTS

| | | |
|---|---|---|
| JP | A-2001-145795 | 5/2001 |
| JP | B2-3644079 | 4/2005 |

* cited by examiner

*Primary Examiner* — Ismael Izaguirre
(74) *Attorney, Agent, or Firm* — Oliff & Berridge, PLC

(57) ABSTRACT

A thread winder includes a thread winding shaft into which a bobbin shaft is inserted so that a bobbin is detachably attached to the thread winding shaft, a rotating mechanism rotating the thread winding shaft to wind a thread on the bobbin, a thread winding shaft switching mechanism switching the thread winding shaft between a preparatory position and a winding position, a guiding member guiding the thread from a thread spool to the bobbin, a guiding member position switching mechanism switching the guiding member between a guide position and a retreat position, and a link mechanism links both switching mechanisms so that the guiding member is located at the guide position when the thread winding shaft assumes the preparatory position and so that the guide member is located at the retreat position when the thread winding shaft assumes the winding position.

18 Claims, 12 Drawing Sheets

THREAD WINDER AND SEWING MACHINE PROVIDED THEREWITH

CROSS-REFERENCE TO RELATED APPLICATIONS

This application is based on and claims the benefit of priority from the prior Japanese Patent Application No. 2008-318223, filed on Dec. 15, 2008, the entire contents of which are incorporated herein by reference.

BACKGROUND

1. Field

The present disclosure relates to a thread winder which winds a thread supplied from a thread spool onto a bobbin attached to a thread winding shaft, and a sewing machine provided with the thread winder.

2. Related Art

A thread winder is generally provided in an arm of a sewing machine to wind a thread supplied from a thread spool, onto an emptied bobbin. A conventional thread winder 1 includes a base 2 mounted on an upper wall of an arm constituting a sewing machine and a thread winding shaft 3 protruding through the base 2 upward as partially shown in FIG. 12. A bobbin 5 is detachably attached to a bobbin holder 4 so as to be placed on the holder. The bobbin 5 includes a cylindrical bobbin shaft 5*a* with upper and lower ends and disc-like flanges 5*b* formed on the upper and lower ends of the bobbin shaft 5*a* respectively.

The thread winding shaft 3 is laterally movable between a preparation position and a winding position although not shown in detail. When the thread winding shaft 3 assumes the winding position, a rubber ring provided on the lower end of the thread winding shaft 3 is pressed against a side surface of a pulley driven by a sewing machine motor thereby to be brought into contact with the latter. As a result, a torque developed by the pulley is transmitted to the thread winding shaft 3 so that the thread winding shaft 3 is rotated, whereby a tread T drawn from the thread spool is wound on the bobbin shaft 5*a* of the bobbin 5.

In execution of a thread winding work, a user firstly attach an empty bobbin 5 to the thread winding shaft 3 assuming the preparation position. The thread T drawn from the thread spool is then passed through a predetermined threading passage, and a distal end of the thread T (a winding start portion) is wound by a small amount on the bobbin shaft 5*a*. Subsequently, the thread winding shaft 3 is moved to the winding position, whereupon a torque is obtainable from the pulley. When the user operates a start/stop switch in this state, a sewing machine motor is driven so that the thread winding shaft 3 is rotated via the pulley, whereby the thread T is wound on the bobbin 5.

When the user carries out the above-described thread winding preparatory work with the aforementioned thread winder, the thread T which should be wound on the bobbin shaft 5*a* sometimes detach downward from the lower flange 5*b* of the bobbin 5. In this case, the thread T detached downward gets into a gap between the flange 5 and the bobbin holder 4, twining around the thread winding shaft 3.

To overcome the above-described problem, a ring-shaped convex portion 6 is provided so as to surround the bobbin holder 4 so that the thread T is prevented from downwardly detaching from the flange 5*b*. In this construction, however, the level of an upper end of the convex portion 6 corresponds with the level of the lower end side flange 5*b* of the bobbin 5 so as not to detach from the flange 5*b*. The level of the upper end of the convex portion 6 cannot exceed the level of the lower end side flange 5*b*. As a result, when the user winds the distal end of the thread T on the bobbin 5 in the preparatory work for thread winding, there is still a possibility that the thread T may get into a space at the side of the underside of the flange 5*b* or the gap between the flange 5 and the bobbin holder 4. Accordingly, the effect of preventing the thread T from twining around the thread winding shaft 3 is insufficient.

SUMMARY

Therefore, an object of the present disclosure is to provide a thread winder which can effectively prevent the thread to be wound on the bobbin from detaching from the bobbin and twining around the thread winding shaft, and a sewing machine provided with the thread winder.

The present disclosure provides a thread winder which winds a thread supplied from a thread spool on a bobbin having flanges on both ends of a cylindrical bobbin shaft respectively, the thread winder comprising a thread winding shaft into which the bobbin shaft is inserted so that the bobbin is detachably attached to the thread winding shaft; a rotating mechanism which rotates the thread winding shaft to wind the thread on the bobbin; a thread winding shaft switching mechanism which switches the thread winding shaft between a preparatory position where a preparatory work is executed in which a winding start portion of the thread is manually wound by a user on the bobbin attached to the thread winding shaft and a winding position where the thread winding shaft is rotated by the rotating mechanism; a guiding member which guides the thread supplied from the thread spool to the bobbin attached to the thread winding shaft so that the thread is wound on the bobbin shaft without detaching to a proximal end side of the thread winding shaft; a guiding member position switching mechanism which switches the guiding member between a guide position where the thread is guided to the bobbin shaft and a retreat position where the guiding member is retreated to the proximal end side of the thread winding shaft; and a link mechanism which links the thread winding shaft switching mechanism and the guiding member position switching mechanism so that the guiding member is located at the guide position when the thread winding shaft assumes the preparatory position and so that the guiding member is located at the retreat position when the thread winding shaft assumes the winding position.

BRIEF DESCRIPTION OF THE DRAWINGS

In the accompanying drawings:

FIGS. 6A and 6B are plan views of the thread winder in the cases where the thread winding shaft assumes the preparatory and winding positions respectively, except for the guiding member and the like;

DETAILED DESCRIPTION

Figure 1A:
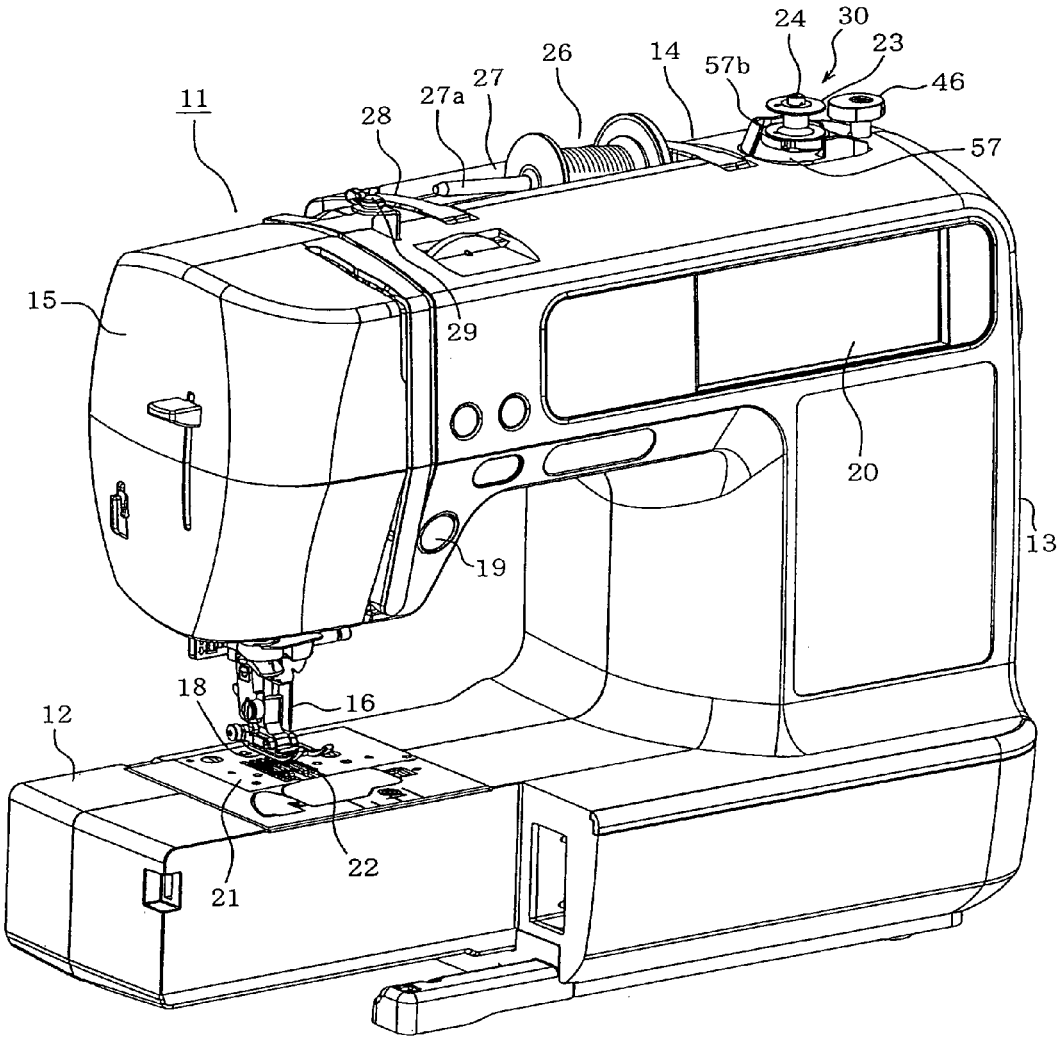
FIG. 1A is a perspective view of a sewing machine incorporating a thread winder of an embodiment, showing the state where a thread winding shaft assumes a preparatory position.
Figure 1B:
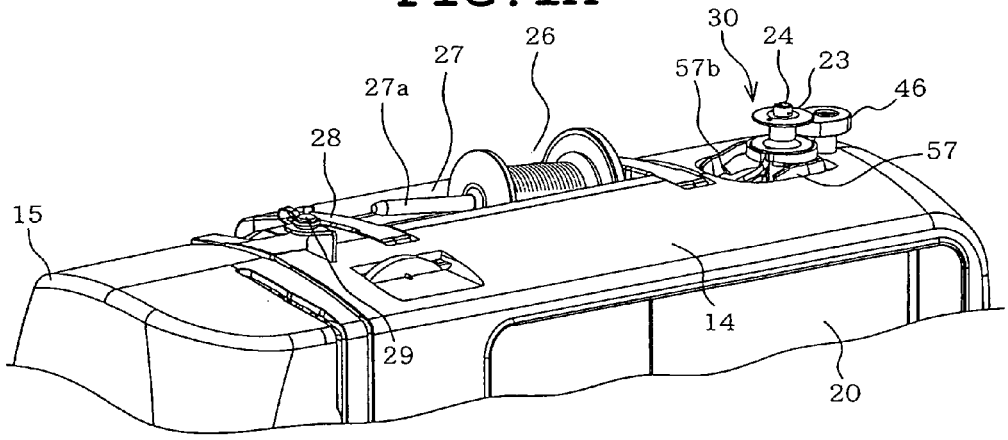
FIG. 1B is a perspective view of an upper part of arm in the case where the thread winding shaft assumes a winding position.

One embodiment will be described with reference to FIGS. 1A to 10D. The embodiment is directed to an electronically controlled household sewing machine. Referring first to FIG. 1A, the electronically controlled household sewing machine 11 is shown in its whole appearance as viewed at the front. The user located at the front operates the sewing machine 11, and the side opposite the user is referred to as "rear." The front-rear direction is referred to as "Y direction." The side where a pillar 13 is located is referred to as "right side" and the side opposite the pillar 13 is referred to as "left side." The right-left direction is referred to as "X direction."

The sewing machine 11 includes a sewing machine bed 12 extending in the right-left direction (X direction), the pillar extending upward from a right end of the bed 12 and an arm 14 extending leftward from an upper end of the pillar 13, all of which are formed integrally with one another. The arm 14 has a distal end serving as a sewing machine head 15. A needle bar (not shown) having a needle 16 is mounted on the underside of the head 15. A presser foot 18 and other components are also mounted on the underside of the head 15. Various operation switches including a start/stop switch 19 instructing start and stop of a sewing operation are provided on a front of the arm 14. A liquid crystal display 20 having a touch panel is also mounted on the front of the arm 14.

A needle plate 21 is mounted on an upper surface of the bed 12 as shown in FIG. 1A. The needle plate 21 is formed with a square hole (not shown) through which a feed dog 22 appears and disappears to feed a workpiece cloth (not shown) to be sewn. In the bed 12 are provided a rotary hook forming stitches in cooperation with the needle 16, a feed dog driving mechanism driving the feed dog 22, and the like although not shown. A bobbin 23 to supply a bobbin thread is detachably set in the rotary hook. A thread T is wound on the bobbin 23. FIGS. 1A to 4B and the like each show the state where the bobbin 23 is set on a thread winding shaft 24 which will be described later. In the bed 12 is provided a lower shaft 25 which serves as a drive source for the rotary hook and the feed dog driving mechanism as partly shown in FIG. 3.

A thread spool storage 27 is provided in the upper surface of the arm 14 so as to be recessed from the upper surface as shown in FIGS. 1A, 1B, 2A and 2B. A thread spool 26 serving as a thread source for the thread T is detachably set in the thread spool storage 27. The thread spool storage 27 is provided with a thread spool shaft 27*a* to which the thread spool 26 is detachably attached. Furthermore, two thread hooks 28 and 29 are provided on the upper surface of the arm 14 so as to be located in the left rear and front of the thread spool storage 27 respectively.

Figure 8:
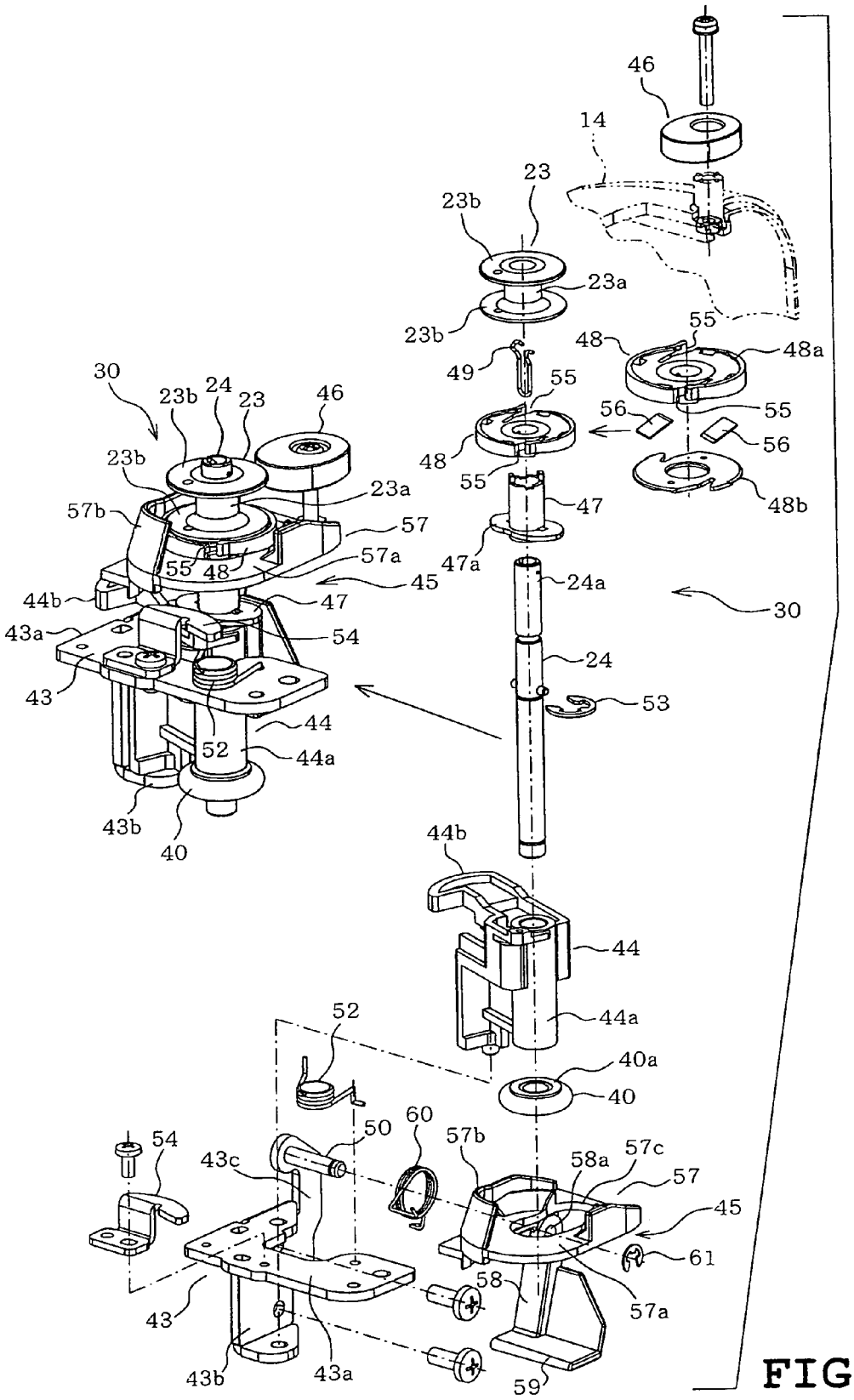
FIG. 8 is an exploded perspective view of the thread winder.

A thread winder 30 is provided on a right end of the arm 14 or on the right of the thread spool storage 27 as will be described in detail later. The thread winder 30 winds the thread T supplied from the thread spool on the bobbin 23 attached to the thread spool shaft 24. The bobbin 23 has a cylindrical bobbin shaft 23*a* and two circular flanges 23*b* mounted integrally on upper and lower ends of the bobbin shaft 23*a* respectively as shown in FIG. 8.

Figure 3:
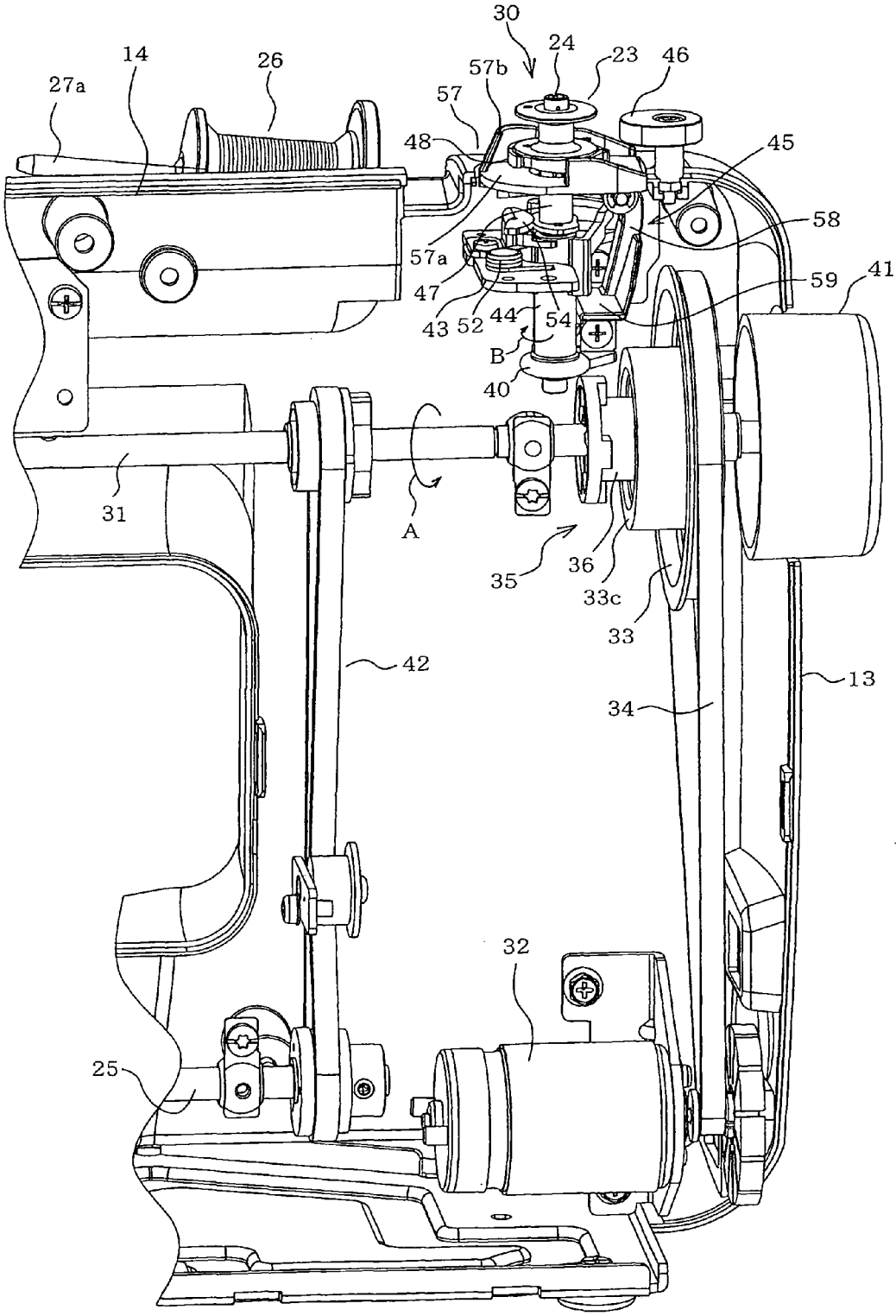
FIG. 3 is a perspective view showing a structure inside a pillar of the sewing machine.
Figure 4B:
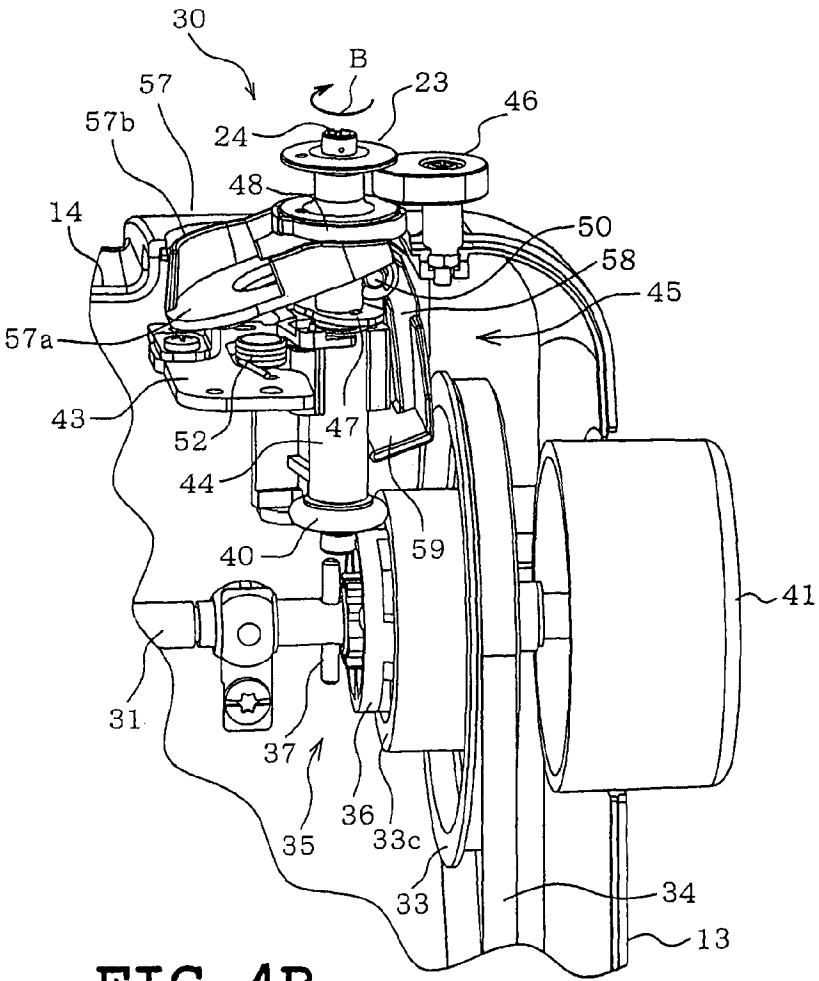
FIGS. 4A and 4B are perspective views of the thread winder in the cases where the thread winding shaft assumes the preparatory and winding positions respectively.
Figure 4A:
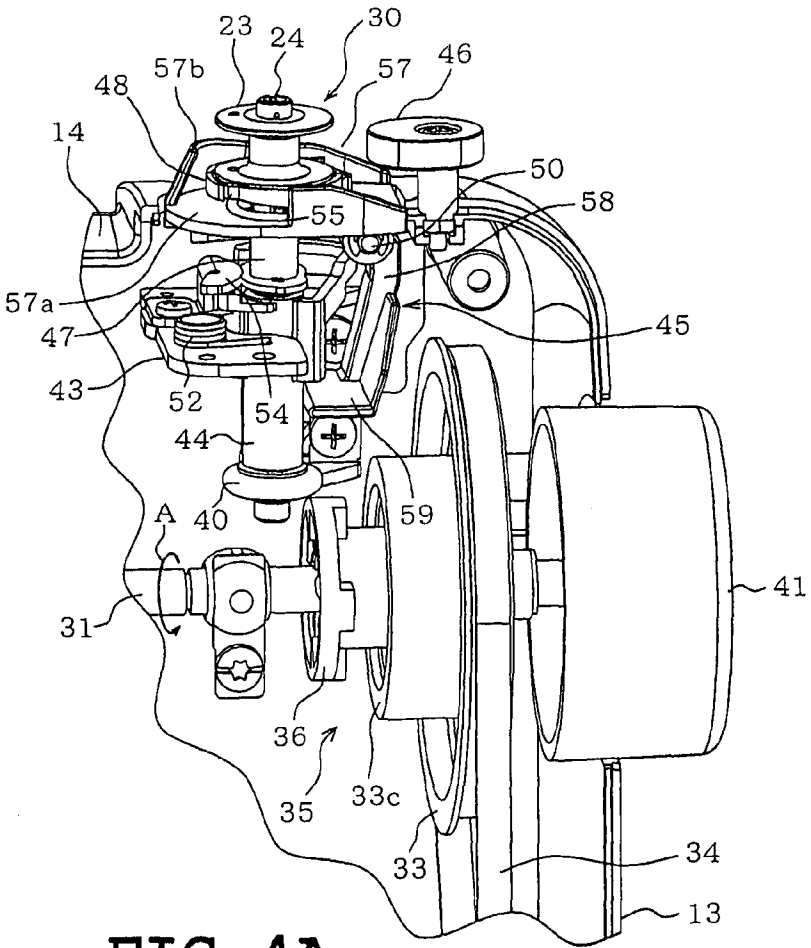
Figure 5A:
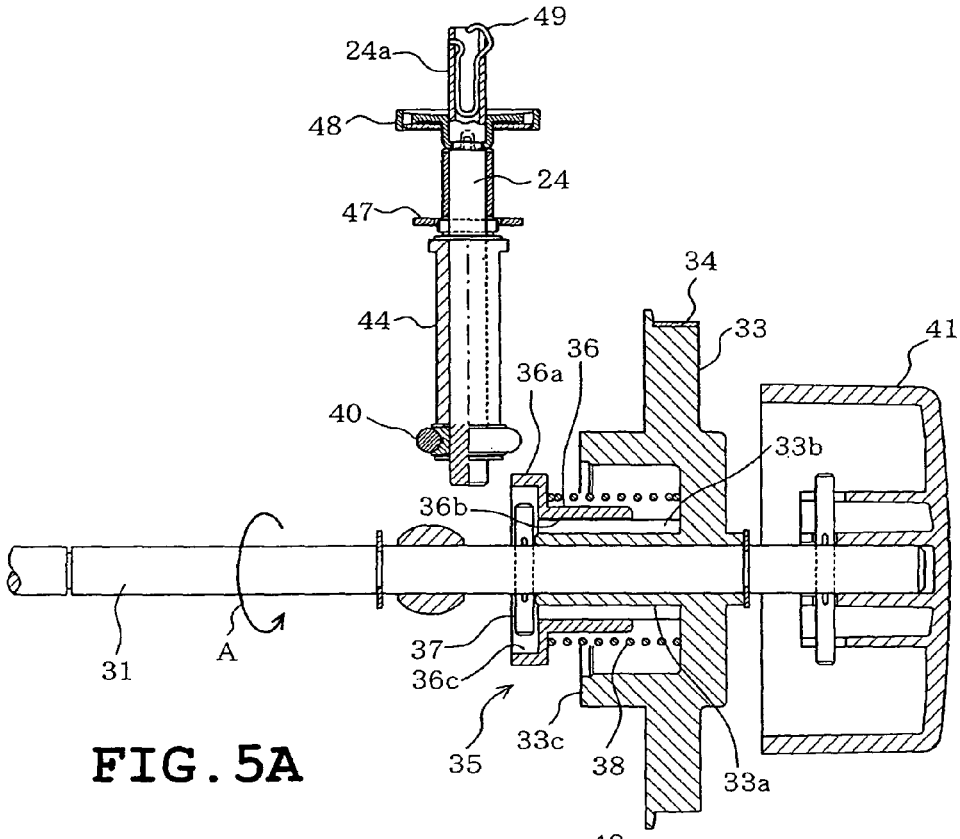
FIGS. 5A and 5B are longitudinally sectional front views of a clutch in the cases where the thread winding shaft assumes the preparatory and winding positions respectively.
Figure 5B:
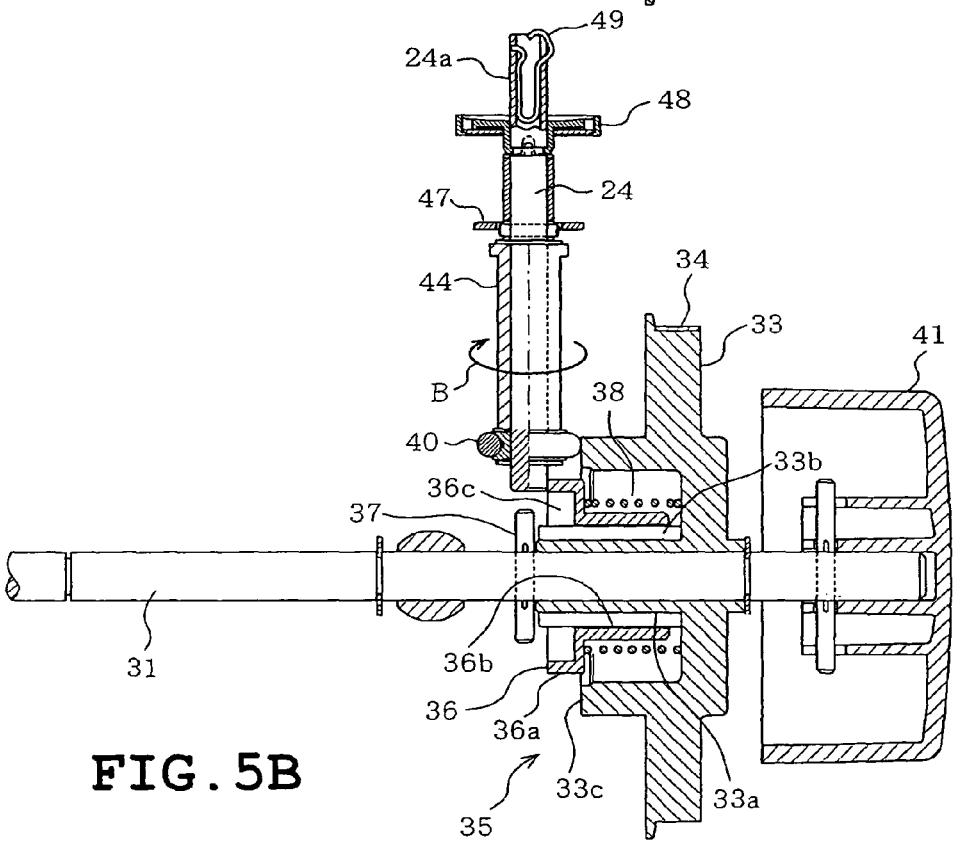

A sewing machine main shaft 31 for driving the needle bar, a needle thread take-up (not shown) and the like is provided in the arm 14 so as to extend in the right-left direction (X direction) as partially shown in FIGS. 3, 5A and 5B. A sewing machine motor 32 is provided on the bottom of the pillar 13 as shown in FIG. 3. A timing pulley 33 is provided in an upper interior of the pillar 13 to drive the main shaft 31 as shown in FIGS. 4A to 5B as well as FIG. 3. A timing belt 34 extends between the motor 32 and the timing pulley 33.

Torque developed by the timing pulley 33 is transmitted via a clutch mechanism 35 to the main shaft 31. In this case, when a normal sewing mode is carried out or when the thread winding shaft 24 as shown in FIGS. 4A and 5A is located at a leftward preparatory position, the timing pulley 33 is coupled with the main shaft 31 by the clutch mechanism 35 so that torque is transmitted to the timing pulley 33. On the other hand, the timing pulley 33 is decoupled from the main shaft 31 while the thread winder 30 is winding the thread T or when the thread winding shaft 24 is located at the rightward winding position as shown in FIGS. 4B and 5B, whereupon the thread winding shaft 24 is rotated.

The clutch mechanism 35 includes a clutch member 36, a transmission pin 37 secured to the main shaft 31, a compression coil spring 38 and the like as shown in FIG. 5. The timing pulley 33 has a centrally located cylindrical support 33*a* through which the main shaft 31 is inserted so that the timing pulley 33 is rotatable. In this case, the timing pulley 33 is axially positioned while being sandwiched between a stop ring 39 and the transmission pin 37 which is secured to the main shaft 31 so as to diametrically extend therethrough. As a result, the timing pulley 33 is rotatably supported on the main shaft so as to be immovable in the right-left direction (axial direction). The cylindrical support 33*a* has an outer circumferential surface formed with a plurality of teeth 33*b* each extending axially or in the right-left direction.

The clutch member 36 is formed into a cylindrical shape and extends in the right-left direction. The clutch member 36 has a flange 36*a* which is integrally formed on the left end thereof and has a larger diameter. The clutch member 36 further has an inner circumferential surface formed with a plurality of concave grooves 36*b* which correspond to the teeth 33*b* of the cylindrical support 33*a* and extend axially or in the right-left direction. As the result of the above-described construction, the teeth 33*b* of the cylindrical support 33*a* are engaged with the grooves of the inner circumferential surface of the clutch member 36, whereby the clutch member 36 is splined to the timing pulley 33. The clutch member 36 is slidable in the direction of shaft center of the main shaft 31.

The flange 36*a* of the clutch member 36 has a coupling recess 36*c* into which the transmission pin 37 is fitted so that the main shaft 31 is rotated together with the clutch member 36. The clutch member 36 is normally urged leftward or in the direction of engagement with the transmission pin 37 by a spring force of a compression coil spring 38 interposed between the timing pulley 33 and the clutch member 36. In this case, when assuming the leftward preparatory position, the thread winding shaft 24 is spaced away leftward from the flange 36*a* and the coupling recess 36*c* is in engagement with the transmission pin 37 of the clutch member 36, as shown in FIG. 5A. As a result, a rotative force of the timing pulley 33 is transmitted to the main shaft 31, so that the main shaft 31 is rotated together with the timing pulley 33 in the direction of arrow A in FIG. 5A.

On the other hand, when the thread winding shaft 24 is manually moved to the rightward winding position by the user, the lower end of the thread winding shaft 24 pushes the flange 36 rightward thereby to move the clutch member 36 rightward. Accordingly, the clutch member 36 and the transmission pin 37 are disengaged from each other. As a result, the rotative force of the timing pulley 33 is not transmitted to the main shaft 31. With this, the rotative force of the timing pulley 33 is transmitted to the thread winding shaft 24 via a rubber ring 40 which will be described later. As a result, the thread winding shaft 24 is continuously rotated in the direction of arrow B in FIG. 5B, that is, clockwise as viewed from above.

In the above-described case, the left side surface of the timing pulley 33 is provided with an integrally formed ring-shaped pressing surface 33*c* for rotating the rubber ring 40 without slip by pressing an outer circumference of the rubber ring 40 is pressed against an outer circumference of the cylindrical support 33*a*. Accordingly, the motor 32, the timing belt 34, the pressing surface 33*c* of the timing pulley 33 and the like constitute a rotating mechanism which rotates the thread winding shaft 24.

The motor 24 is started and stopped on the basis of on-off operation of the start/stop switch 19. A hand pulley 41 operable by the user is mounted on the right end of the main shaft 31 so as to protrude from the right wall of the pillar 13. The main shaft 31 and the lower shaft 25 are coupled with each other by a belt transmission mechanism 42 so that rotation of the main shaft 31 is transmitted to the lower shaft 25 at a ratio of one-to-one, whereby the main shaft 31 and the lower shaft 25 are synchronously rotated.

The thread winder 30 will now be described in more detail with reference to FIGS. 6 to 10 as well as FIGS. 1A to 5B. The thread winder 30 includes a metal mounting base 43, a plastic swing arm 44, the vertically extending thread winding shaft 24, a plastic guiding member 45, and a known bobbin winder stop latch 46 mounted on the upper surface of the arm 14, as shown in FIG. 8 and the like. A positioning cam member 47, a bobbin receiver 48 and a holding spring 49 as well as the aforementioned rubber ring 40.

The mounting base 43 has a generally C-shaped main plate 43*a* as viewed from above, a shaft support 43*b* extending downward from a rear end side of the main plate 43*a*, an extension arm 43*c* extending rightward upward from the main plate 43*a* (see FIG. 8), all of which are formed integrally with the mounting base 43, as shown in FIGS. 6A to 8. The extension arm 43*c* has an upper end from which a pivot shaft 50 extends horizontally frontward, as shown in FIG. 8. The guiding member 45 is swingably supported by the pivot shaft 50 as will be described later. The mounting base 43 is fixedly screwed to a machine casing (not shown) of the arm 14.

The swing arm 44 has a cylindrical portion 44*a* which extends vertically and into which a lower part of the thread winding shaft 24 is rotatably inserted, and an arm 44*b* which is continuous from an upper end of the cylindrical portion 44*a* and extends rearward. Both cylindrical portion 44*a* and arm 44*b* are formed integrally with the swing arm 44. The swing arm 44 is supported at a middle portion and a retracted portion of the arm 44*b* by a vertically extending shaft 51 as shown in FIGS. 6 and 7. As a result, the swing arm 44 is rotatable in the directions of arrows C and D between a right side of the rear end of the main plate 43*a* and the pivot shaft 43*b* of the mounting base 43.

With this, a switching spring 52 for two-position switching extends between a front end of the swing arm 44 and the front end side of the mounting base 43. The switching spring 52 is a toggle spring, and the swing arm 44 is selectively switched between a left swing position as shown in FIGS. 6A and 9 and a right swing position as shown in FIGS. 6B and 10.

The thread winding shaft 24 is rotatably supported by a front end side cylindrical portion 44*a* of the swing arm 44 so as to vertically extend through the cylindrical portion 44*a* as shown in FIGS. 7 and 8. Furthermore, a cylindrical rubber ring holder 40*a* holding the rubber ring 40 on an outer circumference thereof is secured to a lower end part of the thread winding shaft protruding downward from the cylindrical portion 44*a* (except for a lowermost end). A stop ring 53 is fixed to a vertically middle portion of periphery of the thread winding shaft 24. The cylindrical portion 44*a* is held between the stop ring 53 and the rubber ring holder 40*a*, whereby the thread winding shaft 24 is held so as to be axially immovable relative to the swing arm 44. Consequently, the thread winding shaft 24 is switched between a left preparatory position as shown in FIG. 6A and a right winding position as shown in FIG. 6B with the swinging of the swing arm 44 between a right swing position and a left swing position.

The positioning cam member 47 is secured to an upper portion of the thread winding shaft 24 so as to be located on the stop ring 53. The positioning cam member 47 is cylindrical and has a lower end provided with a horizontal plate-shaped cam 47*a* as shown in FIGS. 6A, 6B and 8. The cam 47*a* has a generally gourd-shaped contour such as formed by cutting right and left portions of a disc so that the portions are concaved. A cam abutment plate 54 is mounted on an upper surface of the main plate 43*a* of the mounting base 43 so as to correspond to the cam 47*a* of the positioning cam member 47.

Figure 6A:
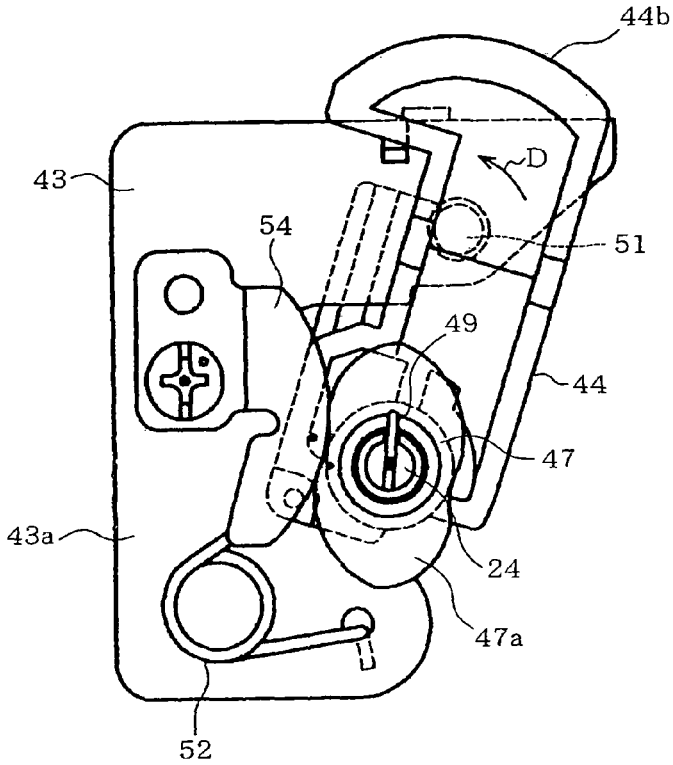
Figure 6B:
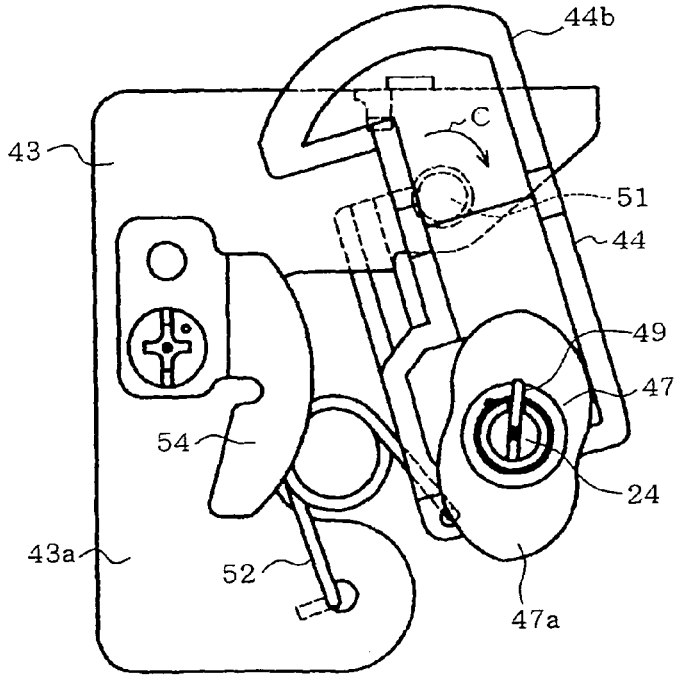
Figure 7:
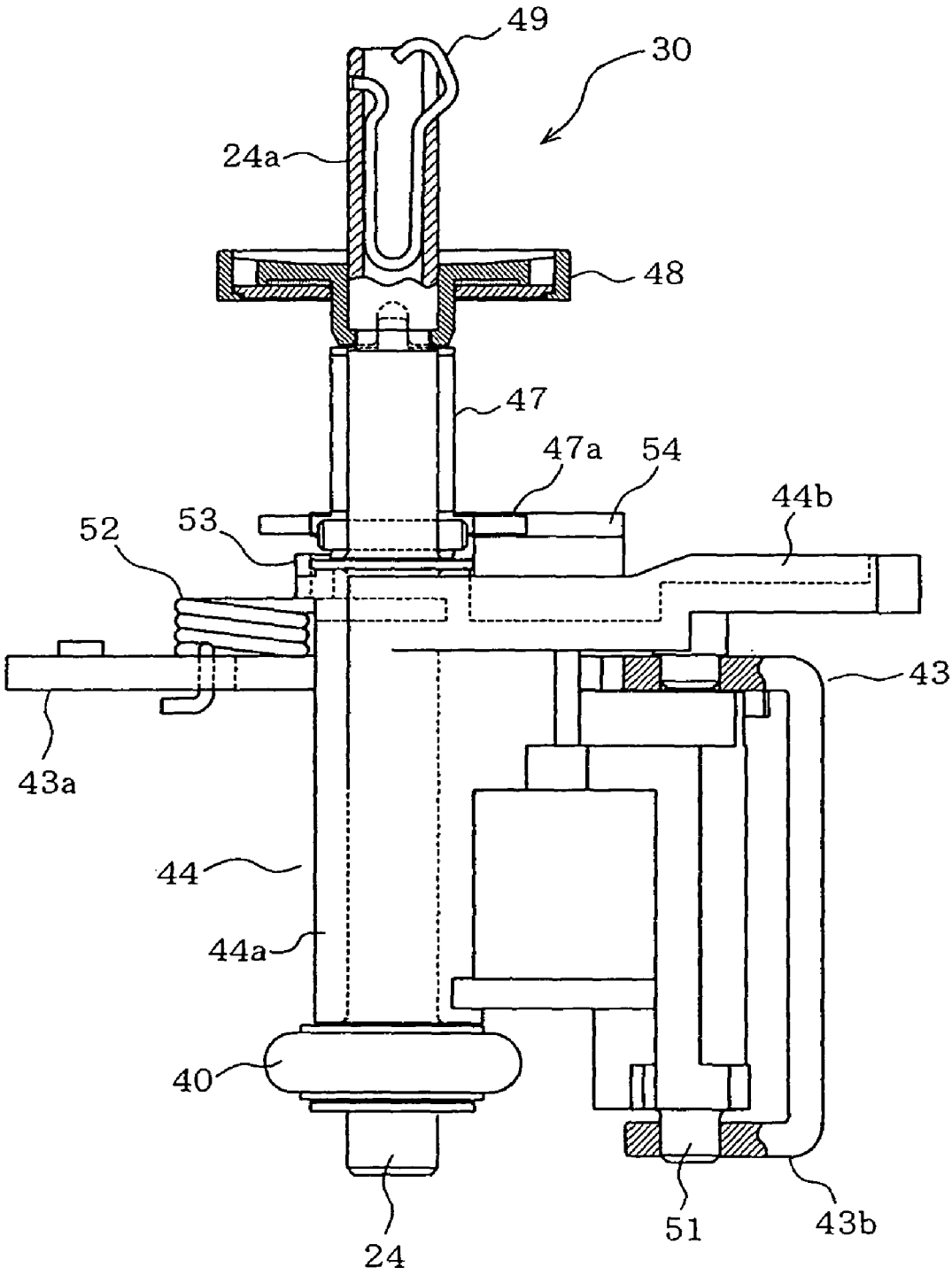
FIG. 7 is a right side view of the thread winder except for the guiding member.

When the swing arm 44 is located at the left swing position such that the thread winding shaft 24 assumes the left preparatory position, one of the concave portions of the cam 47*a* of the positioning cam member 47 engages the cam abutment plate 54 such that the thread winding shaft 24 is locked so as not to be rotated, as shown in FIG. 6A. On the other hand, when the thread winding shaft 24 is displaced to the winding position such that the swing arm 44 is located at the right winding position, the cam member 47 is disengaged from the cam abutment plate 54 such that the thread winding shaft 24 is rendered rotatable, as shown in FIG. 6B. With this, as shown in FIG. 5B, the rubber ring 40 located on the lower end of the thread winding shaft 24 is pressed against the pressing surface 33*c* of the timing pulley 33 so that rotation of the timing pulley 33 is transmitted to the thread winding shaft 24.

A bobbin receiver 48 is secured to the thread winding shaft 24 so as to be located on the top of the cam member 47 as shown in FIGS. 7 and 8. The upper end of the thread winding shaft 24 serves as an attachment portion 24*a* with which the bobbin shaft 23*a* of the bobbin 23 is fitted from above. The bobbin 23 is detachably attached to the thread winding shaft 24 while being placed on the bobbin receiver 48. In this case, the upper end of the bobbin 23 is fixed to the thread winding shaft 24 by a bobbin retaining spring 49 while the bobbin 23 is attached to the attachment portion 24*a* of the thread winding shaft 24. A part of the thread winding shaft 24 located over the bobbin receiver 48 is exposed at the upper surface side of the arm 14 as shown in FIG. 1 and the like.

The bobbin receiver 48 is formed into the shape of a disc having a slightly larger diameter than the flange 23*b* of the bobbin 23 as shown in FIG. 8 and the like. With this, the bobbin receiver 48 is formed with two thread guide grooves 55 extending therethrough in the direction of its thickness (the vertical direction). The thread guide grooves 55 each extend a predetermined distance inward from an entrance of an outer periphery of the bobbin receiver 48 in the direction opposite the rotational direction of the thread winding shaft 24, that is, counterclockwise as viewed from above, whereupon the thread guide grooves 55 have rotational symmetries through 180 degrees. As shown only in FIG. 8, two cutters 56 are provided in inner ends of the thread guide grooves 55 for cutting the thread T respectively. In this case, the bobbin receiver 48 is provided with a circular lid 48*a* and a bottom plate 48*b* constituting the bottom thereof. The cutters 55 are interposed between the lid 48*a* and the bottom plate 48*b*.

The bobbin receiver 48 is provided in alignment with the positioning cam member 47 with respect to the rotational direction. As a result, when the thread winding shaft 24 stops at the preparatory position, an entrance of either one of the thread guide groves 55 of the bobbin receiver 48 is located at a diagonally forward left portion relative to the arm 14, as shown in FIGS. 4A, 9A to 9D and the like. When wishing to carry out thread winding onto the bobbin 23, the user firstly fits the empty bobbin 23 with the attachment portion 24*a* so that the bobbin is placed on the bobbin receiver 48, as will be described later in the operation of the thread winder.

Figure 2A:
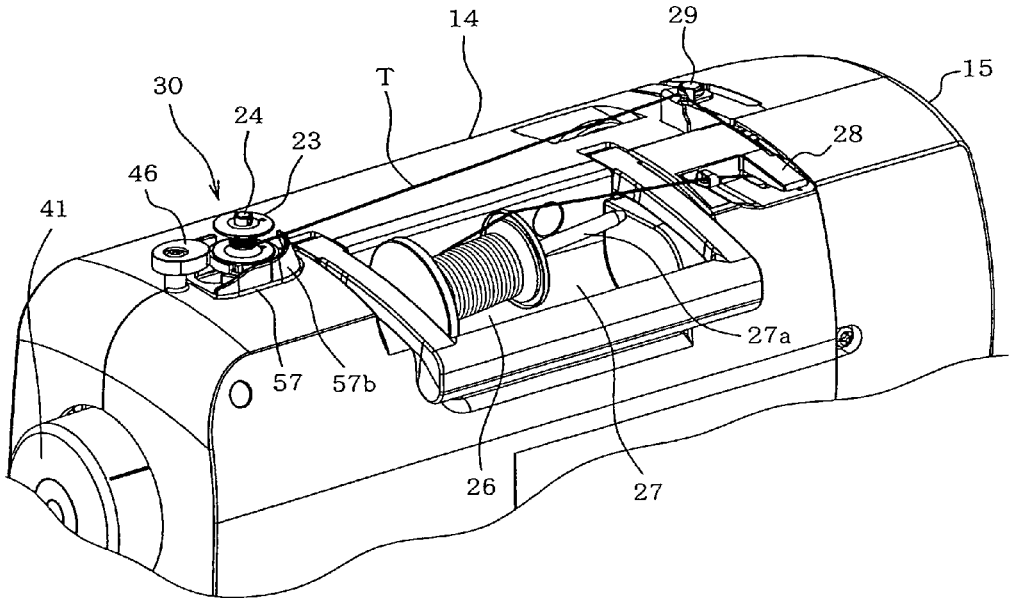
FIGS. 2A and 2B are perspective views of the upper part of arm in the case where the thread winding shaft assumes the respective preparatory and winding positions as viewed from the rear of arm.
Figure 2B:
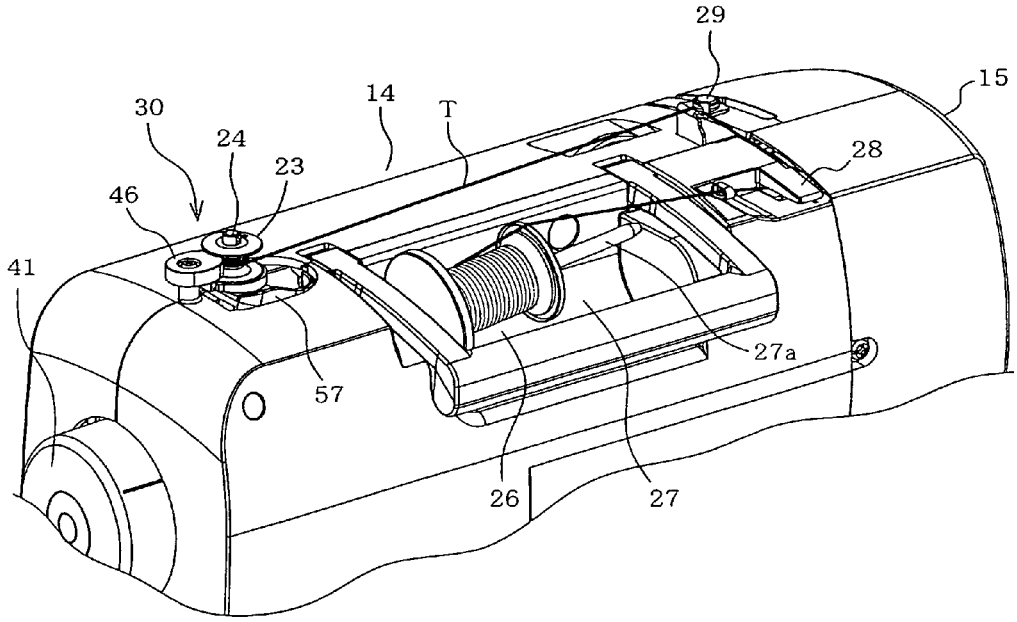

Subsequently, the user handpicks and draws the thread T from the thread spool 26 of the thread storage portion 27, hooking the thread T on thread guards 28 and 29 in turn as shown in FIGS. 2A and 2B. Thereafter, the user manually winds a winding start part of the thread T on the bobbin shaft 5*a* of the bobbin 23 several times. Thereafter, the distal end side of the remaining thread T is passed through the thread guide groove 55 of the bobbin receiver 48, and an extra thread is cut. The above-described work is referred to as "preparatory work." Subsequently, when the user moves the thread winding shaft 24 to the winding position and turns on the start/stop switch 19, the bobbin 23 is rotated together with the thread winding shaft 24 so that the winding operation is executed.

The bobbin winder stop latch 46 is located just to the right of the bobbin 23 in the case where the thread winding shaft 24 assumes the winding position, as shown in FIG. 4B and the like. The peripheral surface of the thread T wound on the bobbin 23 is brought into contact with the bobbin winder stop latch 46 when a thread winding completion state where a predetermined amount of thread T, for example, the thread T ranging from 70% to 90%, has been wound on the bobbin 23 comes close. The bobbin 23 and accordingly thread winding shaft 24 are relatively pressed leftward by the bobbin winder stop latch 46. As a result, the thread winding shaft 24 is stopped when the rubber ring 40 is departed leftward from the pressing surface 33*c* such that rotation transmission is interrupted.

The guiding member 45 is provided for reliably guiding the thread T without drop to the proximal end side of the thread winding shaft 24 or downward drop in this case so that the thread T is reliably wound on the bobbin shaft 29*a*. The guiding member 45 is constructed as follows. In the embodiment, the guiding member 45 is composed as an integral plastic component having a support member serving as a guiding member position switching mechanism and a transmission member serving as a link mechanism, both of which members are formed integrally with each other.

More specifically, the guiding member 45 has a guiding member main part 57 located at an upper part thereof, a swing lever 58 serving as a supporting member which extends slightly diagonally leftward downward from a lower right rear end of the main part 57, and a contact plate 59 serving as a plate-shaped transmitting member which extends leftward from a lower end of the swing lever 58, all of which are formed integrally with one another. The guiding member 45 is mounted on the mounting base 43 so as to be movable or swingable in this case between a guide position as shown in FIGS. 9A to 9D and a retreat position as shown in FIG. 10.

The guiding member 57 is formed into a horizontally long substantially rectangular shape and has a rising wall 57*b* which rises on an upper surface of a bottom plate 57*a* with a semicircular right side while being inclined upwardly slightly inward. Furthermore, the bottom plate 57*a* is formed with a long hole 57*c* which is long horizontally or in the right-left direction. The upper cylindrical portion of the positioning cam member 47 of the thread winding shaft 24 is inserted through the long hole 57*c* and moved in the right-left direction. More specifically, the bottom plate 57*a* is disposed on a lower portion of the bobbin receiver 48.

The rising wall 57*b* is disposed so as to surround the bobbin 23 in proximity to an area surrounding the bobbin 23 attached to the thread winding shaft 24 when the guiding member 45 is located at a guide position (see FIGS. 4A and 9A to 9D) as will be described later. However, the rising wall 57*b* includes a part corresponding to the entrance of either one of the thread guide grooves 55 of the bobbin receiver 48, that is, the diagonally forward left portion which has been cut out or is open.

Figure 9D:
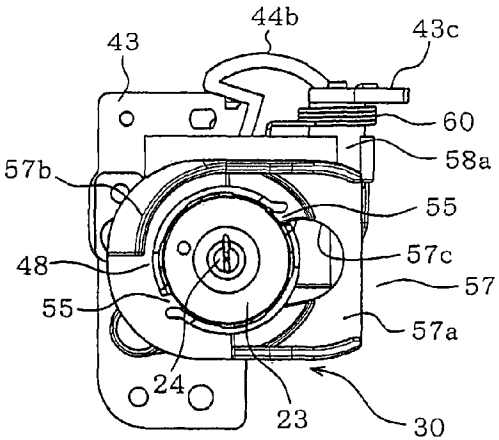
FIGS. 9A to 9D are front, left side, right side and plan views of the thread winder in the case where the guiding member is located at a guide position, respectively.
Figure 9C:
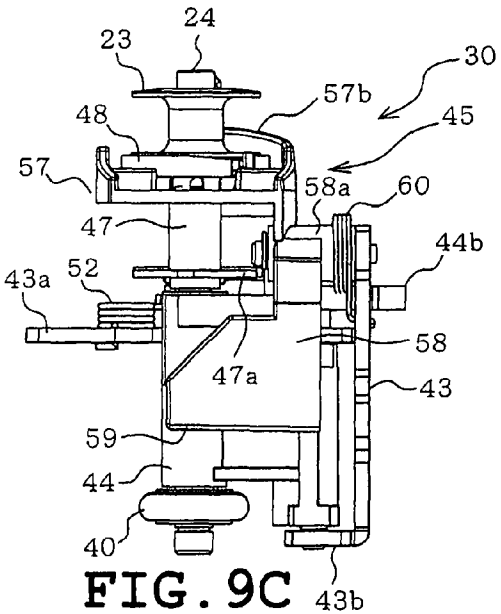
Figure 9A:
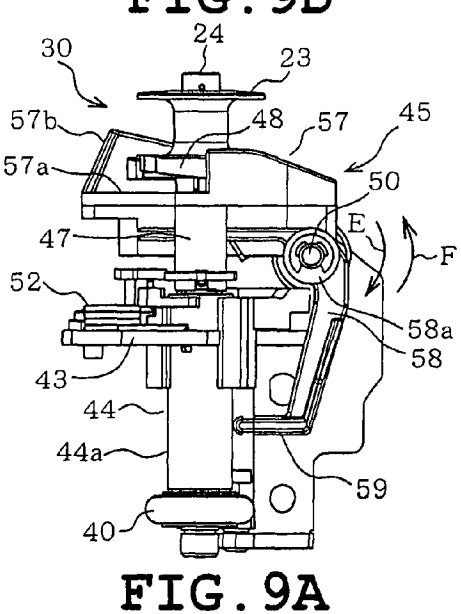
Figure 9B:
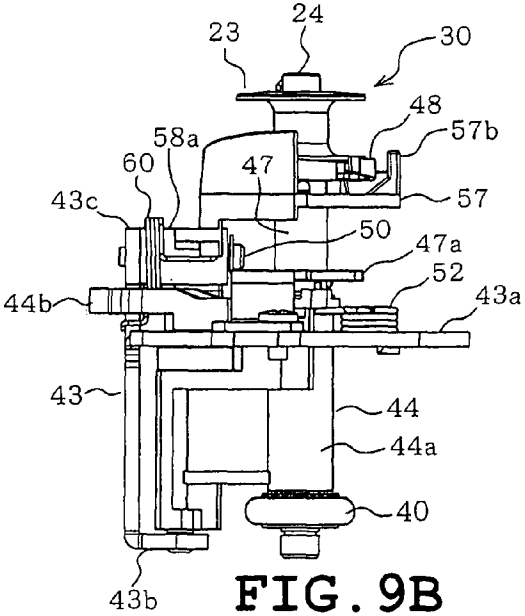

The rising wall 57*b* includes a left portion which is located on the supply path of the thread T and is highest. The rising wall 57*b* becomes gradually lower from the left portion. When the guiding member is located at the guide position, an upper end of the rising wall 57*b* is located at a heightwise middle portion of the bobbin 23 attached to the thread winding shaft 24, that is, between both flanges 23*b*, as shown in FIGS. 4A, 9A and the like. When the guiding member 45 is switched to a retreat position which will be described later, the upper end of the rising wall 57*b* is lowered to the bobbin receiver 48, as shown in FIGS. 4B and 10A to 10D.

Figure 10D:
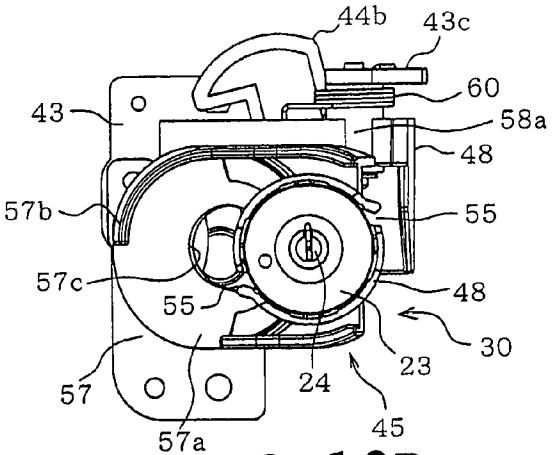
FIGS. 10A to 10D are front, left side, right side and plan views of the thread winder in the case where the guiding member is located at a retreat position, respectively.
Figure 10C:
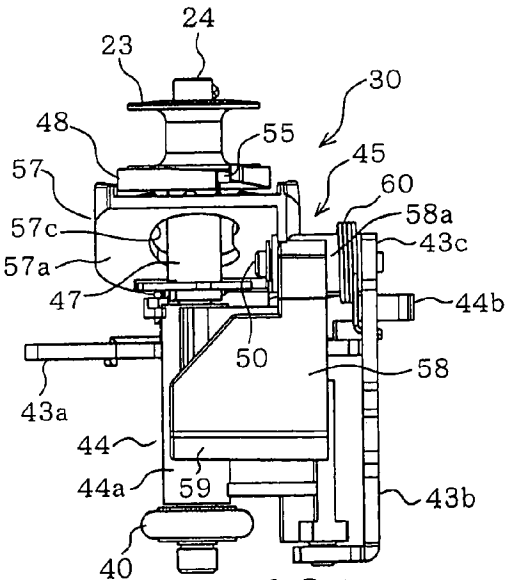
Figure 10A:
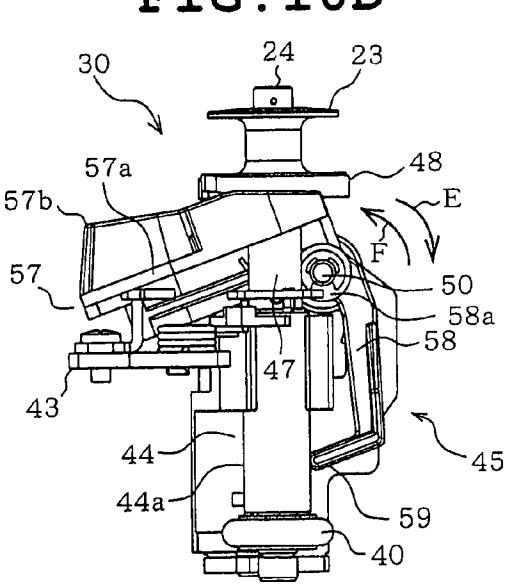
Figure 10B:
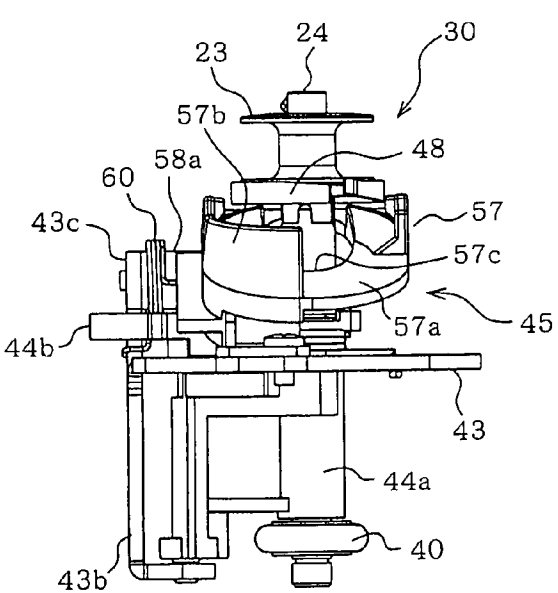

The swing lever 58 includes a cylindrical portion 58*a* which has a through hole which is located near the upper end thereof and extends in the front-back direction. The through hole extends rearward. The pivot shaft 50 is fitted into the cylindrical portion 58*a* of the swing lever 58, and the guiding member 45 is prevented from falling off by a stop ring 61 (see FIG. 8). As a result, the guiding member 45 is supported on the mounting base 43 so as to be pivotable (swingable) about the pivot shaft 50. Furthermore, a torsion coil spring 60 is provided between the swing lever 58 and the mounting base 43 so as to be loosely fitted with the outer periphery of the cylindrical portion 58*a*, whereupon the guiding member 45 is normally urged in the direction of arrow E as shown in FIGS. 9A, 10A and the like. The contact plate 59 has a distal end which is normally in contact with the circumferential surface of the cylindrical portion 44*a* of the swing arm 44 by the urging force of the torsion coil spring 60.

In this case, when the thread winding shaft 24 assumes the preparatory position, the bottom plate 57*a* of the guiding member main portion 57 becomes substantially horizontal, and the rising wall 57*b* is located at the guide position where the rising wall 57*b* is located so as to surround the bobbin 23, as shown in FIGS. 4A and 9A-9D. When the guiding member 45 is located at the guide position, the thread T can be guided so as to be wound on the bobbin shaft 23*a* without being dropped downward when the user winds the winding start portion of the thread T supplied from the thread spool 26 in order that the user may carry out the preparatory work.

On the other hand, when the thread winding shaft 24 is moved rightward from the preparatory position so as to be switched to the winding position, the contact plate 59 is pressed rightward by the cylindrical portion 44*a* of the swing arm 44 as shown in FIG. 10A and the like. The guiding member 45 is swung in the direction of arrow F in FIG. 10A about the pivot shaft 50 against the spring force, thereby assuming the retreat position. As a result, the thread winding shaft 24 is relatively displaced rightward in the long hole 57*c*, and the rising wall 57*b* of the guiding member main portion 57 is retreated downward, whereupon the lateral area around the bobbin 23 is open. When the thread winding shaft 24 is returned from the winding position to the preparatory position, the guiding member 45 is of course switched to the guide position.

The thread winder 30 constructed as described above will works as follows. In a normal operation including a sewing operation, the thread winding shaft 24 is located at the preparatory position, and the guiding member 45 is located at the guide position, as shown in FIGS. 1A, 2A, 3, 4A, 5A, 6A and 9A. When the user wishes to execute the winding of thread T on the empty bobbin 23, the user executes the following preparatory work while the sewing machine 11 (the motor 32) is stopped.

The user attaches the bobbin 23 to the attachment portion 24*a* of the upper end of the thread winding shaft 24. With this, the user sets the thread spool 26 in the thread spool storage portion 27 and draws the distal end of the thread T from the thread spool 26. After the thread T has been hooked on the thread guards 28 and 29 in turn, the user manually winds the winding start portion of the thread T onto the bobbin shaft 23*a* of the bobbin 23 several times. In this case, the guiding member 45 assumes the guide position and the rising wall 57*b* rises on the thread supply path or just to the left of the bobbin 23, as shown in FIG. 2A and the like. Accordingly, a path through which the thread T is passed when the user winds the thread T on the bobbin shaft is limited to the upper side of the rising wall 57*b*.

Accordingly, the user can reliably wind the thread T on the bobbin 23 from the vertically middle of the bobbin shaft 23*a* to the upper side without the thread T dropping downward. In this case, when no guiding member is provided or when the convexity 6 is provided as described in the description of the conventional construction, there is a possibility that the needle thread may drop downward thereby to get into the gap between the flange of the bobbin and the bobbin receiver. In the foregoing embodiment, however, the thread T is reliably guided to the bobbin shaft 23*a*.

After having wound the thread T on the bobbin shaft 23*a* several times, the user passes the distal end of the remaining thread T through the thread guide groove 55 of the bobbin receiver 48 and cuts an extra portion of the thread T. In this case, the rising wall 57*b* includes the diagonally forward left portion which corresponds to the entrance of the thread guide groove 55 of the bobbin receiver 48 and which is cut out or is open, as shown in FIGS. 9A, 9D and the like. Accordingly, the rising wall 57*b* can be prevented from blocking the work for passing the thread T through the thread guide groove 55, whereupon the user can carry out the work smoothly.

Thus, the preparatory work has been completed and the user then manually moves the thread winding shaft 24 rightward. As a result, as shown in FIGS. 5B and 6B, the thread winding shaft 24 is switched to the winding position, and the outer periphery of the rubber ring 40 is pressed against the pressing surface 33*c* of the timing pulley 33. With this, the clutch member 36 is moved rightward so that the timing pulley 33 is decoupled from the main shaft 31. Furthermore, the guiding member 45 is swung in the direction of arrow F thereby to be moved to the retreat position, and the rising wall 57*b* retreats downward, as shown in FIGS. 1B, 2B, 4B and 10.

Subsequently, the user turns on the start/stop switch 19. The motor 32 is then driven so that the bobbin 23 is rotated together with the thread winding shaft 24, whereby the winding operation is executed. In this state, the winding operation is executed without the rising wall 57*b* of the guiding member 45 standing in the way of thread winding, whereupon the thread winding can be executed. Thereafter, when the predetermined amount of threat T has been wound on the bobbin 23 such that the thread winding comes close to a completed state, the thread T wound on the bobbin 23 and the bobbin winder stop latch 46 are brought into contact with each other, so that the thread winding shaft 24 and accordingly the rubber ring 40 are displaced leftward. As a result, the drive force of the timing pulley 33 is not transmitted to the thread winding shaft 24 such that the rotation of the thread winding shaft 24 is stopped.

When admitting that rotation of the thread winding shaft 24 and accordingly the bobbin 23 has been stopped such that the winding operation has been completed, the user turns off the start/stop switch 19 thereby to stop the motor 32. Subsequently, the thread winding shaft 24 is returned to the preparatory position, and the bobbin on which the thread T has been wound is detached from the thread winding shaft 24. Furthermore, when the thread winding shaft 24 is returned to the preparatory position, the guiding member 45 is swung in the direction of arrow E in FIGS. 9A and 10A thereby to be returned to the guide position. With this, the timing pulley 33 and the main shaft 31 are coupled together by the clutch mechanism 35, whereupon the sewing operation can be executed.

According to the foregoing embodiment, the guiding member 45 is switchable between the guide position and the retreat position, and the position of the guiding member is switched in conjunction with the location of the thread winding shaft 24. As the result of this construction, when the user carries out the preparatory work for thread winding, the guiding member 45 assuming the guide position guides the thread T supplied from the thread spool 26 without the thread T dropping downward from the bobbin attached to the thread winding shaft 24, whereupon the thread T can reliably be wound on the bobbin shaft 23*a*. Furthermore, the winding of the thread T on the bobbin 23 can be prevented from being blocked by the guiding member 45.

Particularly in the foregoing embodiment, the guiding member 45 includes the guiding member main portion 57, the swing lever 58 which serves as the supporting member for supporting the guiding member 45 so that the guiding member is movable between the guide position and the retreat position, the contact member 59 which serves as the transmitting member for transmitting the position switching operation of the thread winding shaft 24 to the swing lever 58, all of which are constituted as the integral component. Accordingly, the construction of the thread winder can be simplified, and the whole thread winder can be rendered more compact, whereby space saving can be achieved.

Figure 11A:
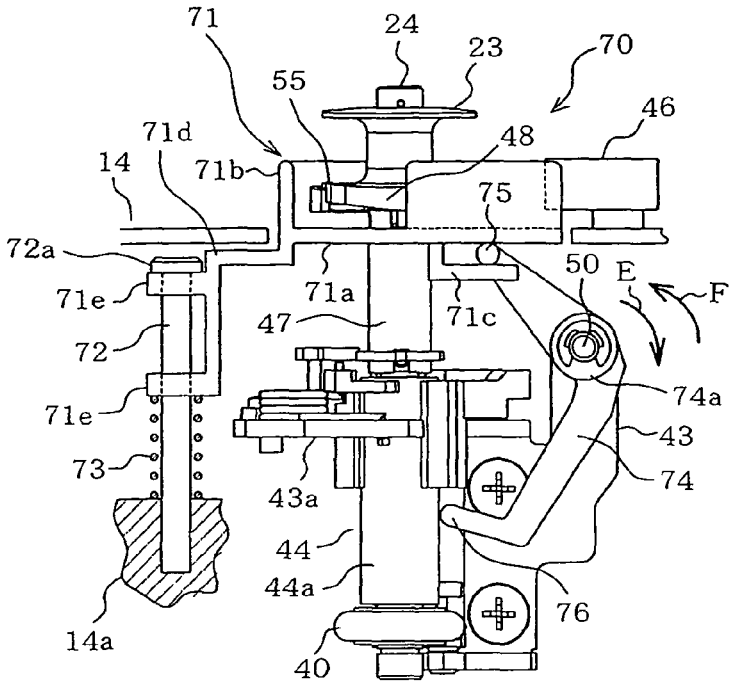
FIGS. 11A and 11B are longitudinally sectional front views of the thread winder of another embodiment in the cases where the guiding member is located at the guide and retreat positions, respectively.
Figure 11B:
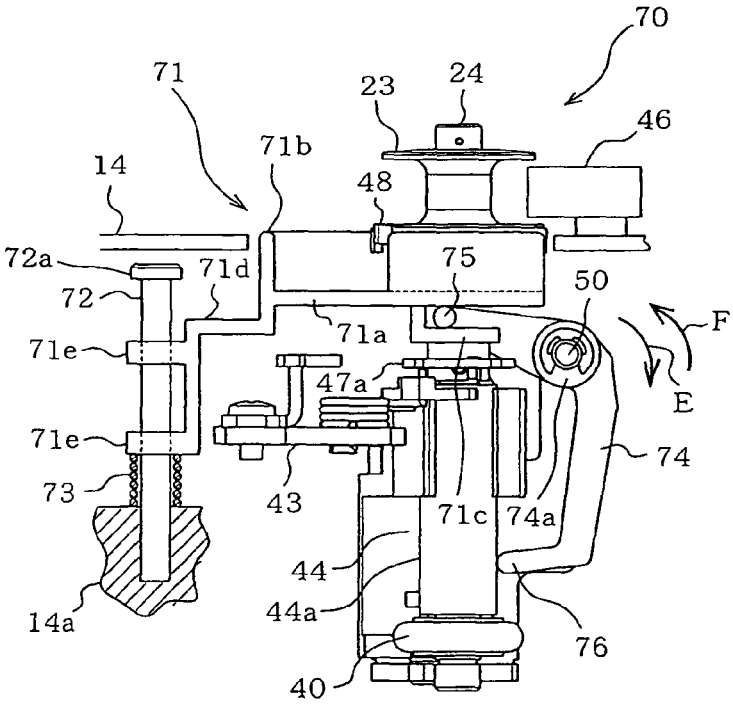
Figure 12:
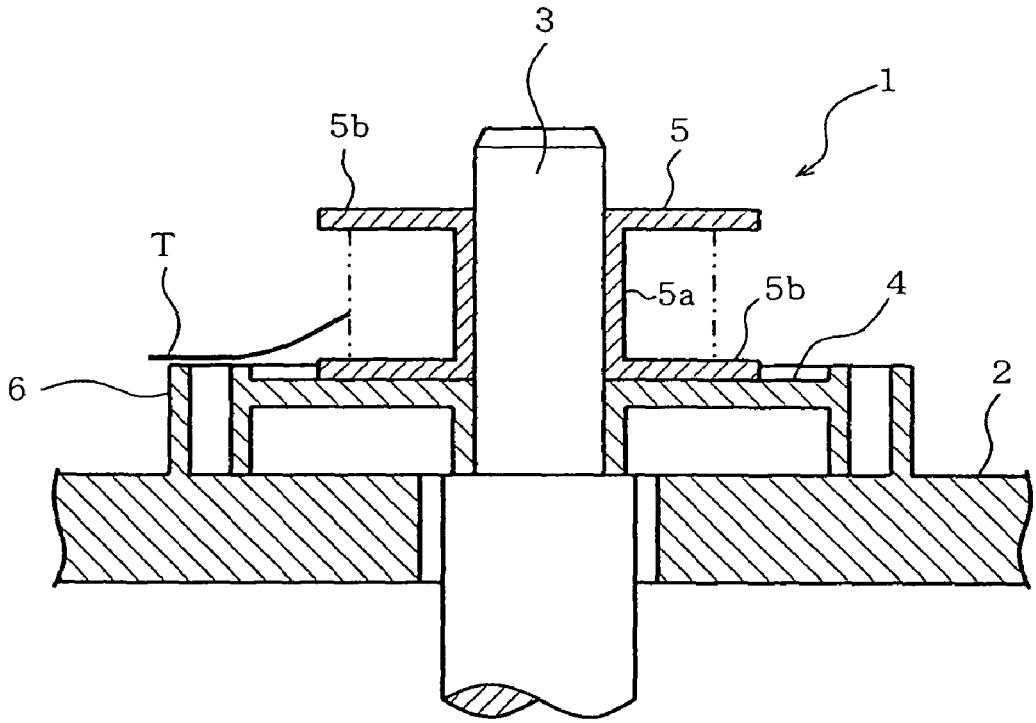
FIG.12 RELATED ART
FIG. 12 is a longitudinally sectional front view of a distal end of thread winding shaft in a conventional thread winder.

FIG. 11 illustrates the thread winder 70 of another embodiment. The thread winder 70 differs from the thread winder 30 of the foregoing embodiment in the construction of the guiding member 71 and the guiding member position switching mechanism or the supporting member. The guiding member position switching mechanism switches the guiding member 71 between the guide position as shown in FIG. 11A and the retreat position as shown in FIG. 11B. Accordingly, identical or similar parts are labeled by the same reference symbols as those in the foregoing embodiment, and detailed description of these identical or similar parts and figures are eliminated. Only the difference will be described as follows.

The guiding member 71 has the rising wall 71*b* formed integrally on the upper surface of the horizontal bottom plate 71*a*. In this case, the rising wall 71*b* is disposed so as to surround the bobbin 23 in proximity to the area surrounding the bobbin 23 attached to thread winding shaft 24. When the guiding member 71 is located at the guiding member 71 guiding position (see FIG. 11A), the upper end of the rising wall 71*b* is located at the heightwise middle portion of the bobbin 23 attached to the thread winding shaft 24, that is, between both flanges 23*b*. Furthermore, the rising wall 71*b* includes a part corresponding to the entrance of either one of the thread guide grooves 55 of the bobbin receiver 48, that is, the diagonally forward left portion which has been cut out or is open.

The thread winding shaft 24 or the upper cylindrical portion of the positioning cam member 47 is inserted through the bottom plate 71*a* of the guiding member 71. In this case, the bottom plate 71*a* is formed with a long hole which is moved in the right-left direction and is long in the right-left direction. A coupling portion 71*c* is formed integrally on a rightward portion of the underside of the bottom plate 71. A coupling pin is coupled to the coupling portion 71*c* so as to be relatively movable in the right-left direction as will be described later. Furthermore, an extending portion 71*d* is formed integrally on a left end of the bottom plate 71*a*. The extending portion 71*d* extends leftward from the underside of the bottom plate 71*a* and further downward. The extending portion 71*d* has two upper and lower guide rings 71*e*.

The arm 14 includes a frame 14*a* to which a guide bar 72 is secured so as to extend vertically upward. The guide bar 72 is inserted through the aforesaid guide rings 71*e* so that the guide rings 71*e* are vertically movable. The guide bar 72 has an upper end formed with a flange 72*a* having a larger diameter. Furthermore, a coil spring 73 is provided about a circumference of the guide bar 72 so as to be located between the lower guide ring 71*e* and the frame 14*a*. As a result, the guide rings 71*e* are guided by the guide bar 72 so that the guiding member 71 is vertically movable. With this, the guiding member 71 is urged upward by the coil spring 73 so that the upper guide ring 71*e* is normally stopped at an uppermost position where the upper guide ring 71*e* abuts on the flange 72*a*. The uppermost position serves as a guide position.

On the other hand, the swing lever 74 serving as the support member is swingably mounted on the mounting base 43. In this case, the swing lever 74 has both ends which are bent so as to extend diagonally upwardly leftward and diagonally downwardly leftward respectively. The swing lever 74 includes a cylindrical portion 74*a* provided on the central bent portion thereof. The pivot shaft 50 of the mounting base 43 is inserted into the cylindrical portion 74*a* so that the swing lever 74 is swingable in the directions of arrows E and F in FIGS. 11A and 11B. The swing lever 74 has a coupling pin 75 formed integrally on the upper end thereof. The coupling pin 75 is engaged with the coupling portion 71*c*. The contact plate 75 is formed integrally on the lower end of the swing lever 74 so as to extend leftward. The contact plate 75 serves as the transmitting member having a distal end which is brought into contact with the circumferential surface of the cylindrical portion 44*a* of the swing arm 44.

As the result of the above-described construction, when the thread winding shaft 24 is located at the preparatory position, the swing lever 74 assumes the position as shown in FIG. 11A. The guiding member 71 is stopped at the guide position where the rising wall 71*b* is located so as to surround the bobbin 23. On the other hand, when the thread winding shaft 24 is switched from the preparatory position to the winding position, the contact plate 76 is pressed rightward by the cylindrical portion 44*a* of the swing arm 44 such that the swing lever 74 is swung in the direction of arrow F, as shown in FIG. 11B. Consequently, the coupling pin 75 pulls the coupling portion 71*c* downward against the spring force of the coil spring 73, thereby lowering and moving the guiding member 71 to the retreat position. When the guiding member 71 assumes the retreat position, the upper end of the rising wall of 71*b* is level with the bobbin receiver 48. When the thread winding shaft 24 is returned to the preparatory position, the guiding member 71 is returned to the guide position.

Accordingly, the thread winder 70 can achieve the same effect as the above-described thread winder 30, that is, the thread T can reliably guided without downward drop so as to be wound on the bobbin shaft 23*a* when the user winds the winding start portion of the thread T supplied from the thread spool 26, on the bobbin 23. When the preparatory work has been completed and the user moves the thread winding shaft 24 to the winding position, the guiding member 71 is moved to the retreat position and the rising wall 71*b* is retreated downward. Consequently, the winding operation can be executed without blocking by the guiding member 71.

In each of the foregoing embodiments, the height of the upper end of the rising wall of the guiding member assuming the guide position is determined so that the upper end of the rising wall is located at the middle between both flanges 23*b* of the bobbin 23. However, the height of the upper end of the rising wall may be determined so that the upper end of the rising wall is located between both flanges 23*b* of the bobbin 23, instead. An individual drive source such as a solenoid or air cylinder may be employed as a means that switches the location of the guiding member. The shape and structure of the guiding member may each be modified in various modes.

Furthermore, the construction of the thread winder may be modified. For example, a sensor may be provided for directly or indirectly detecting an amount of thread T wound on the bobbin 23 so that the completion of thread winding is determined based on the result of detection by the sensor, instead of the construction that the completion of the winding operation is controlled by the bobbin winder stop latch 46. Furthermore, the thread winding shaft 24 may be rotated by a gear mechanism, instead of the rubber ring 40. An individual drive source, that is, an electric motor dedicated to thread winding may be provided, instead of the sewing machine motor used as the drive source of the thread winding shaft 24.

Regarding the construction of the thread winder, the guiding member position switching mechanism may be constructed so as to switch the individual guiding member between the guide position and the retreat position, instead of linking the thread winding shaft and the guiding member. According to the alternative construction, the guiding member can be moved to the retreat position merely in the case where the guiding member assuming the guide position stands in the way or the like. In this case, a holding mechanism may be provided for holding the guiding member at the guide position and/or the retreat position. In the foregoing embodiments, the thread winding shaft, the link mechanism (transmitting member) and the like function as the holding mechanism to hold the position of the guiding member. Thus, the foregoing embodiments are not restrictive and may be modified or expanded.

The foregoing description and drawings are merely illustrative of the principles of the present disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A thread winder which winds a thread supplied from a thread spool on a bobbin having flanges on both ends of a cylindrical bobbin shaft respectively, the thread winder comprising:

a thread winding shaft into which the bobbin shaft is inserted so that the bobbin is detachably attached to the thread winding shaft;

a rotating mechanism which rotates the thread winding shaft to wind the thread on the bobbin;

a thread winding shaft switching mechanism which switches the thread winding shaft between a preparatory position where a preparatory work is executed in which a winding start portion of the thread is manually wound by a user on the bobbin attached to the thread winding shaft and a winding position where the thread winding shaft is rotated by the rotating mechanism;

a guiding member which guides the thread supplied from the thread spool to the bobbin attached to the thread winding shaft so that the thread is wound on the bobbin shaft without detaching to a proximal end side of the thread winding shaft;

a guiding member position switching mechanism which switches the guiding member between a guide position where the thread is guided to the bobbin shaft and a retreat position where the guiding member is retreated to the proximal end side of the thread winding shaft; and a link mechanism which links the thread winding shaft switching mechanism and the guiding member position switching mechanism so that the guiding member is located at the guide position when the thread winding shaft assumes the preparatory position and so that the guiding member is located at the retreat position when the thread winding shaft assumes the winding position.

2. The thread winder according to claim 1, wherein when located at the guide position, the guiding member is disposed on a thread supply passage along which the thread is supplied from the thread spool.

3. The thread winder according to claim 1, wherein:

the thread winding shaft is disposed so as to vertically extend;

the guiding member has a rising wall which rises upward and limits a passage through which the thread passes, the rising wall having an upper end;

when the guiding member assumes the guide position, the upper end of the rising wall is level with the flange of the bobbin at the lower end side; and when the guiding member assumes the retreat position, the upper end of the rising wall is level with or is located lower than the flange of the bobbin at the lower end side.

4. The thread winder according to claim 1, wherein when assuming the guide position, the guiding member comes close to a periphery of the bobbin attached to the thread winding shaft so as to surround at least a part of the periphery of the bobbin.

5. The thread winder according to claim 1, wherein the guiding member position switching mechanism has a supporting member which supports the guiding member so that the guiding member is movable between the guide position and the retreat position.

6. The thread winder according to claim 5, wherein the link mechanism includes a transmitting member which transmits an operation of the thread winding shaft switching mechanism to switch a position of the thread winding shaft to the supporting member.

7. The thread winder according to claim 6, wherein the guiding member, the supporting member and the transmitting member are constructed into an integral component.

8. A sewing machine which includes an arm and a thread winder which winds a thread supplied from a thread spool on a bobbin having flanges on both ends of a cylindrical bobbin shaft respectively, the thread winder comprising:

a thread winding shaft into which the bobbin shaft is inserted so that the bobbin is detachably attached to the thread winding shaft;

a rotating mechanism which rotates the thread winding shaft to wind the thread on the bobbin;

a thread winding shaft switching mechanism which switches a position of the thread winding shaft between a preparatory position where a preparatory work is executed in which a winding start portion of the thread is manually wound by a user on the bobbin attached to the thread winding shaft and a winding position where the thread winding shaft is rotated by the rotating mechanism;

a guiding member which guides the thread supplied from the thread spool to the bobbin attached to the thread winding shaft so that the thread is wound on the bobbin shaft without detaching to a proximal end side of the thread winding shaft;

a guiding member position switching mechanism which switches the guiding member between a guide position where the thread is guided to the bobbin shaft and a retreat position where the guiding member is retreated to the proximal end side of the thread winding shaft; and a link mechanism which links the thread winding shaft switching mechanism and the guiding member position switching mechanism so that the guiding member is located at the guide position when the thread winding shaft assumes the preparatory position and so that the guiding member is located at the retreat position when the thread winding shaft assumes the winding position.

9. The sewing machine according to claim 8, wherein when located at the guide position, the guiding member is disposed on a thread supply passage along which the thread is supplied from the thread spool.

10. The thread winder according to claim 8, wherein:

the thread winding shaft is disposed so as to vertically extend;

the guiding member has a rising wall which rises upward and limits a passage through which the thread passes, the rising wall having an upper end;

when the guiding member assumes the guide position, the upper end of the rising wall is level with the flange of the bobbin at the lower end side; and when the guiding member assumes the retreat position, the upper end of the rising wall is level with or is located lower than the flange of the bobbin at the lower end side.

11. The thread winder according to claim 8, wherein when assuming the guide position, the guiding member comes close to a periphery of the bobbin attached to the thread winding shaft so as to surround at least a part of the periphery of the bobbin.

12. The thread winder according to claim 8, wherein the guiding member position switching mechanism has a supporting member which supports the guiding member so that the guiding member is movable between the guide position and the retreat position.

13. The thread winder according to claim 12, wherein the link mechanism includes a transmitting member which transmits an operation of the thread winding shaft switching mechanism to switch a position of the thread winding shaft to the supporting member.

14. The thread winder according to claim 13, wherein the guiding member, the supporting member and the transmitting member are constructed into an integral component.

15. A sewing machine which includes an arm and a thread winder which winds a thread supplied from a thread spool on a bobbin having flanges on both ends of a cylindrical bobbin shaft respectively, the thread winder comprising:

a thread winding shaft into which the bobbin shaft is inserted so that the bobbin is detachably attached to the thread winding shaft;

a rotating mechanism which rotates the thread winding shaft to wind the thread on the bobbin;

a guiding member which guides the thread supplied from the thread spool to the bobbin attached to the thread winding shaft so that the thread is wound on the bobbin shaft without detaching to a proximal end side of the thread winding shaft; and a guiding member position switching mechanism which switches the guiding member between a guide position where the thread is guided to the bobbin shaft and a retreat position where the guiding member is retreated to the proximal end side of the thread winding shaft.

16. The sewing machine according to claim 15, wherein the thread winder includes a holding mechanism which holds the guiding member at the guide position when the guiding member assumes the guide position.

17. The sewing machine according to claim 15, wherein the thread winder includes a holding mechanism which holds the guiding member at the retreat position when the guiding member assumes the retreat position.

18. The sewing machine according to claim 15, wherein the thread winder includes a holding mechanism which holds the guiding member at the guide position when the guiding member assumes the guide position, and the holding mechanism holds the guiding member at the retreat position when the guiding member assumes the retreat position.

* * * * *